US005782357A

United States Patent [19]

Johnson

[11] Patent Number: 5,782,357

[45] Date of Patent: Jul. 21, 1998

[54] GREETING CARD AND RETAINING TRAY ASSEMBLY

[76] Inventor: Keith D. Johnson, 10217 1st Ave., Inglewood, Calif. 90303

[21] Appl. No.: 785,885

[22] Filed: Jan. 21, 1997

Related U.S. Application Data

[63] Continuation-in-part of Ser. No. 364,122, Dec. 27, 1994, Pat. No. 5,595,008, which is a continuation-in-part of Ser. No. 235,451, Apr. 29, 1994, Pat. No. 5,435,085.

[51] Int. Cl.[6] ..... B65D 73/00

[52] U.S. Cl. ..... 206/461; 206/557; 206/764; 206/768

[58] Field of Search ..... 206/216, 423, 206/461, 470, 557, 564, 764, 767, 768

[56] References Cited

U.S. PATENT DOCUMENTS

| | | | |
|---|---|---|---|
| 3,856,137 | 12/1974 | Brindley | 206/564 |
| 3,974,957 | 8/1976 | Benzon-Petersen | 206/470 |
| 4,083,453 | 4/1978 | Berger et al. | 206/564 |
| 4,840,275 | 6/1989 | Faiola et al. | 206/423 |
| 5,435,085 | 7/1995 | Johnson | 40/124.1 |
| 5,595,008 | 1/1997 | Johnson | 40/124.1 |

*Primary Examiner*—David T. Fidei
*Attorney, Agent, or Firm*—Robert J. Schaap

[57] ABSTRACT

A greeting card and retaining tray assembly comprised of a greeting card constructed with a pair of foldable panels and having an inner gift receiving receptacle capable of retaining a gift such as a living plant, a bottle of wine, etc. to be presented to a recipient of the card. The receptacle may contain an inner liner enabling the retention of water. In this way, the greeting card serves not only to present a greeting, but also functions as a gift holder for a gift which may be given to the receiver, along with the greeting card. The greeting card and the tray both can be constructed of foldable paper stock material. Initially, flat sheets of paper or paperboard material are provided and folded into both the card and the tray. The tray is preferably triangularly shaped and holds the card in a standing upright position. Moreover, the tray provides room for additional gift items and/or other decorative items. Thus the greeting card becomes a relatively permanent item, as opposed to one which is disposable and immediately discarded.

29 Claims, 3 Drawing Sheets

GREETING CARD AND RETAINING TRAY ASSEMBLY

RELATED APPLICATION

This application is a continuation-in-part of my U.S. patent application Ser. No. 08/364,122, now U.S. Pat. No. 5,595,008 filed Dec. 27, 1994 for "Greeting Card Device" and which is, in turn, a continuation-in-part of my U.S. patent application Ser. No. 235,451 filed Apr. 29, 1994 for Greeting Card Device (now U.S. Pat. No. 5,435,085 dated Jul. 25, 1995).

BACKGROUND OF THE INVENTION

1. Field of the Invention

This invention relates in general to certain new and useful improvements in a novel greeting card and tray supporting arrangement in which a novel greeting card having a pocket to present a gift to a recipient can be self-supported in a retraining tray which may also contain other gift items to be presented to a recipient.

2. Brief Description of the Prior Art

Greeting cards are well known and have been commercially available in one form or another for well over 100 years. While advances have been made in the art of greeting cards, such as in the types of paper, the printing involved and the like, the cards have essentially remained unchanged.

Most commercially available greeting cards usually comprise a single sheet of paper or a paper stock material or paperboard stock material so that a pair of panels which lie in facewise engagement with one another is provided. Usually printing is provided on one or more faces of these panels and may or may not be accompanied by illustrations or other designs.

There have also been several embodiments of greeting cards which utilize three or more panels. Again, these greeting cards may contain various forms of printed material and/or artistic material presented thereon. Beyond the fact that the greeting cards usually have a plurality of panels with artistic and graphic materials presented thereon, very little has changed in the art of greeting cards over the years.

It is a common practice to bequeath flowers or grown plants along with a greeting card, particularly on special occasions, such as birthdays, certain holidays and the like. In all cases, the grown plant will usually accompany the greeting card in a separate package or it may be inserted temporarily between the two panels of a greeting card when given to a recipient. However, after the recipient receives the greeting card with the grown plant, the plant is removed and introduced into a separate vase with water.

In my now issued U.S. Pat. No. 5,435,085 dated Jul. 25, 1995 for a Greeting Card Device there is provided a greeting card which has an interior pocket for receiving a gift to be presented to a recipient of the card. It has been found in connection with that novel greeting card device that it would be desirable to provide some means for retaining the card. Typically, when the card is stored in an upright position, the two panels forming part of the card are folded to a 90° position relative to one another. However, there is no means to assure that they will remain at this angular position for best supporting the card. Thus, a tray which holds the greeting card has been found to be needed.

In addition to the foregoing, it is often times desirable to provide other gifts which may be auxiliary to a gift or other presentation to a recipient of the greeting card. Thus, for example, in addition to a bottle of perfume, the giver may also wish to give candies to the recipient of the greeting card. The bottle of perfume could be retained in the pocket of the greeting card although the candies would have to be stored in a tray or similar arrangement.

In essentially all cases, the greeting card itself usually becomes disposable and is discarded within a few days after receipt. This is at least partially due to the fact that the greeting card itself has no other utilitarian purpose. In many cases, the grown plant is retained for a much longer period than the greeting card. As a result, the greeting card has little utility and does become disposable.

OBJECTS OF THE INVENTION

It is, therefore, one of the primary objects of the present of the present invention to provide a novel greeting card device which has means for permanently supporting an object therein and a retaining tray therefor.

It is another object of the present invention to provide a novel combination greeting card and tray support for holding a greeting card in an upright position.

It is a further object of the present invention to provide a novel greeting card device and retaining tray combination and which supports a gift item by providing an integral housing in the card device and a receiving area in the tray for receiving an additional gift item.

It is an additional object of the present invention to provide a supporting tray for use with greeting cards in order to hold the greeting card in an upright position.

It is another salient object of the present invention to provide a novel greeting card device and tray combination of the type stated which renders the greeting card device permanently useful and eliminates the quick disposal of the greeting cards normally found with conventional greeting cards.

It is yet another object of the present invention to provide a greeting card and combination tray support of the type stated which is relatively inexpensive to manufacture, but which is highly useful and effective for maintaining a greeting card and a gift item offered therewith.

With the above and other objects in view, my invention resides in the novel features of form, construction, arrangement and combination of parts presently described and pointed out in the claims.

SUMMARY OF THE INVENTION

A novel greeting card assembly which comprised of a novel greeting card and a novel tray used in connection with that greeting card. The tray is designed to retain the greeting card in an upright position and also in an open position, as hereinafter described.

The present invention primarily uses a greeting card of the type described in my now issued U.S. Pat. No. 5,435,085 dated Jul. 25, 1995 for "greeting card device" and while that device may be described in connection with the retaining of grown plant substances, the greeting card device may also be used in connection with the retention of and the presentation of other articles. In addition, the tray forming part of the invention is not necessarily limited to use with the novel greeting card of the type described, but can be used with any multi-panel greeting card for retaining same in an upright position and for retaining same in an opened position.

The greeting card assembly of the present invention usually includes a plurality of panels, such as a pair of panels, connected along a fold line. The exterior faces of these panels may be provided with printed messages or otherwise with graphic illustrations thereon and, for that matter, one or both of the interior panels could have portions thereof provided with such printed material or graphic illustrations, or both.

Located in the panels of the greeting card are a pair of hingedly connected pocket forming walls which together with the interior surfaces of the panels form a gift receiving pocket in the nature of a receptacle for a gift item. This pair of hingedly connected walls usually lies in flat facewise engagement with the panels when the panels are disposed in a closed position. However, when the panels are opened at a 90 degree angle, the interior walls will also separate and become disposed to one another at approximately a 90 degree angle. Thus, the interior surfaces of the pair of panels and the pair of walls form a somewhat rectangularly shaped receptacle for receipt of the gift item.

In one embodiment of the invention, the gift receiving pocket has a central pocket which may be closed by a bottom wall. In this case, the bottom wall may be comprised of a pair of bottom sections which may be connected to the panels or the pocket forming walls and which bend downwardly to form a relatively flat bottom wall. In another embodiment, the central pocket is not provided with a rigid bottom wall formed of the same material as the card itself. If desired, a plastic liner can be secured within the pocket-forming walls forming the pocket and the liner itself is in the form of a sack which includes a bottom wall.

The present invention also includes a unique tray designed to retain the greeting card in an open position and also to retain the card in an upright position. Although the card itself may be capable of standing in an upright position when the two panels are opened relative to one another at a 90° angle, the insertion of a heavy gift such as a bottle of wine or the like into the gift-receiving pocket may tend to cause the card to become unstable. The tray of the present invention will retain the card in this upright position even with a moderately heavy gift item located within the gift receiving pocket. In addition, the tray of the present invention will retain the panels of the greeting card in an opened angular position and essentially in a position where the two panels are perpendicularly disposed relative to one another.

The tray forming part of the present invention may also be formed of the same paper or paperboard material which is used in the formation of the card. Preferably, it also includes the same design format on the surface thereof.

The tray of the present invention includes a relatively flat bottom wall formed of the paper or paperboard material and an integrally formed upstanding peripheral side wall. This side wall is also triangularly shaped. Moreover, the bottom wall will receive the lower edges of the two panels of the greeting card when the latter is disposed in the tray and in an upright position. The triangularly shaped side wall of the tray will engage lower portions of the exterior faces of the panels when the latter are opened to a right angled position. Moreover, they will essentially fully engage these lower portions of the side walls of the panel.

As indicated previously, in one embodiment of the invention, the greeting card device of the invention may include a plastic water-proof sack secured within the pocket. In this case, this sack or plastic liner is tubular and is only opened at its upper end such that it is capable of supporting water therein. In this way, the liner will be capable of retaining a grown plant, such as a flower, or the like.

As also indicated previously, the present invention is not so limited to the use of flowers, but rather may also be used for the presentation of other gift items, such as lingerie, perfumes, bottles of wine and the like. In addition, the tray forming part of the greeting assembly of the invention also has additional space located between the interior surfaces of the two panels to receive other types of gift items, as for example, candies or the like.

In accordance with the above-identified construction, when a recipient receives the card device, he or she can open it to a position where they are capable of reading and observing the printed messages and the graphics thereon. The recipient may also receive a gift item. Thus, when the greeting card has its panels disposed at approximately a 90 degree angle relative to one another, the pocket forming walls will also assume a 90 degree angle with respect to one another and with respect to the panels to which they are attached.

This greeting card device provides an ideal housing for holding a gift item, such as a flower, for a substantial period of time. Moreover, it is designed to hold the gift item right in the greeting card itself. Consequently, the greeting card becomes a useful object which actually can function as not only an element which portrays a message, but also supports the gift item bequeathed with it.

This invention possesses many other advantages and has other purposes which may be made more clearly apparent from a consideration of the forms in which it may be embodied. These forms, as shown in the drawing forming a part of and accompanying the present specification. They will now be described in detail for purposes of illustrating the general principles of the invention, but it is to be understood that the following detailed description and the accompanying drawings are not to be taken in a limiting sense.

BRIEF DESCRIPTION OF THE DRAWINGS

Figure 1:
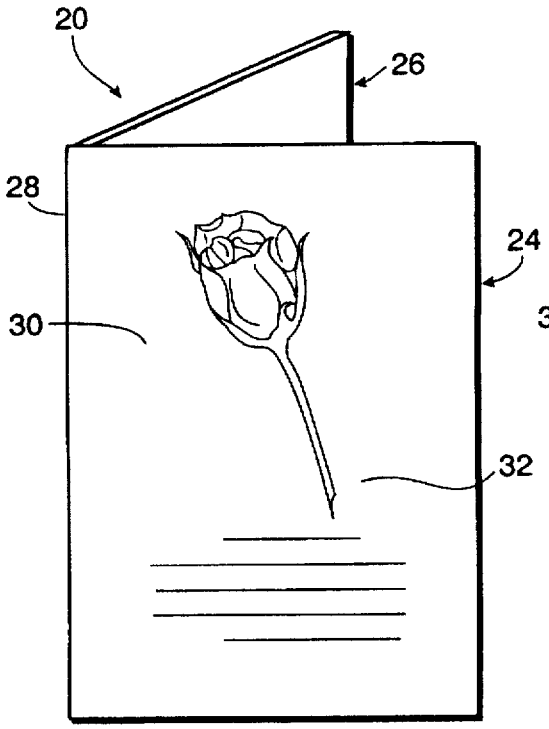
Figure 2:
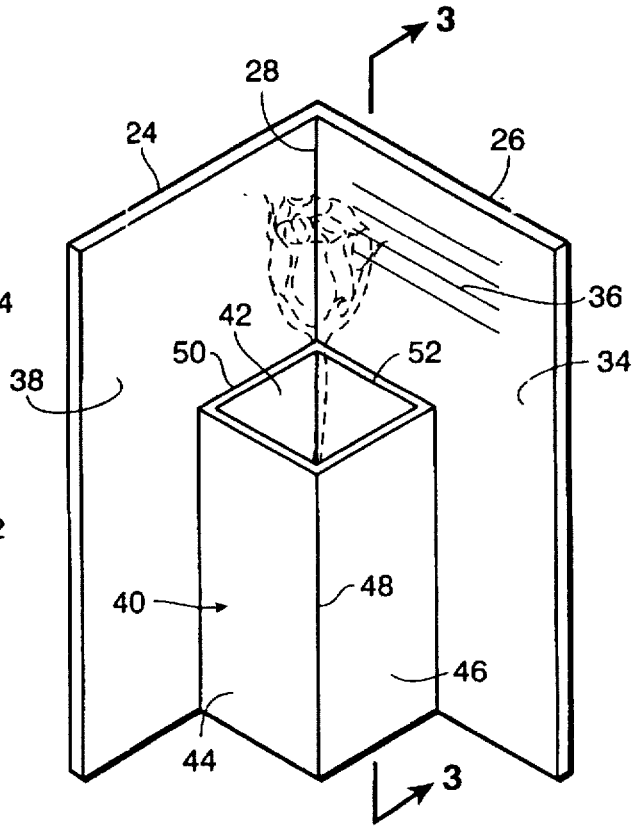
Figure 3:
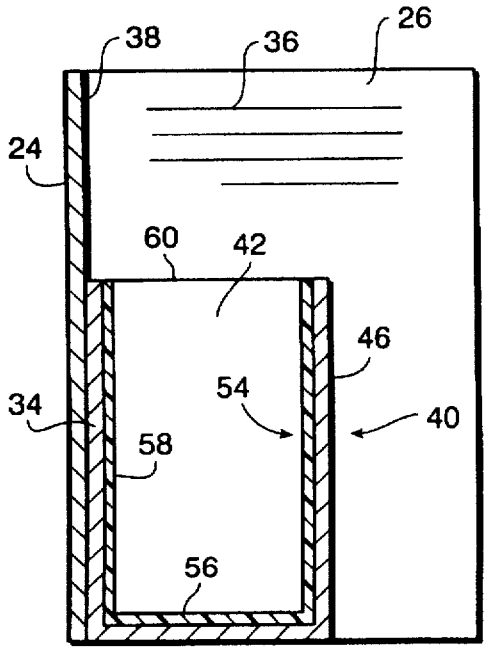
Figure 4:
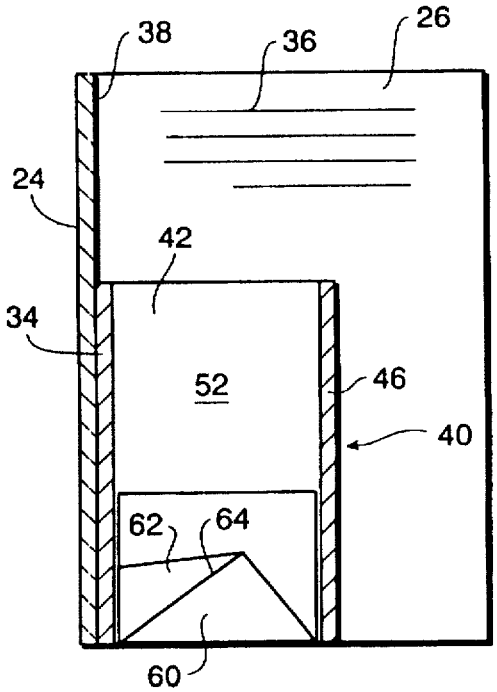
Figure 5:
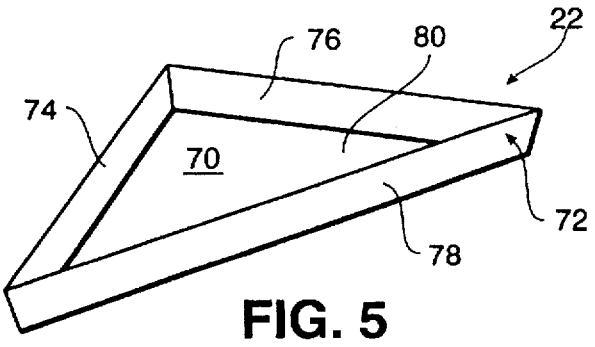
Figure 6:
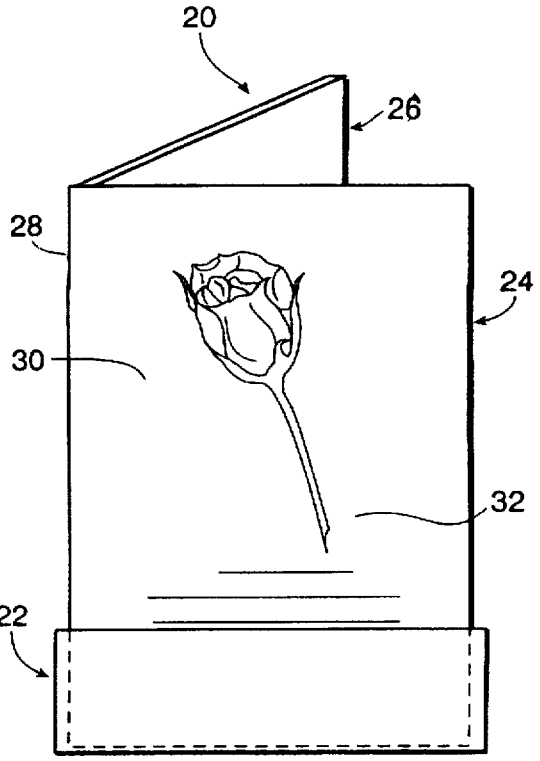
Figure 7:
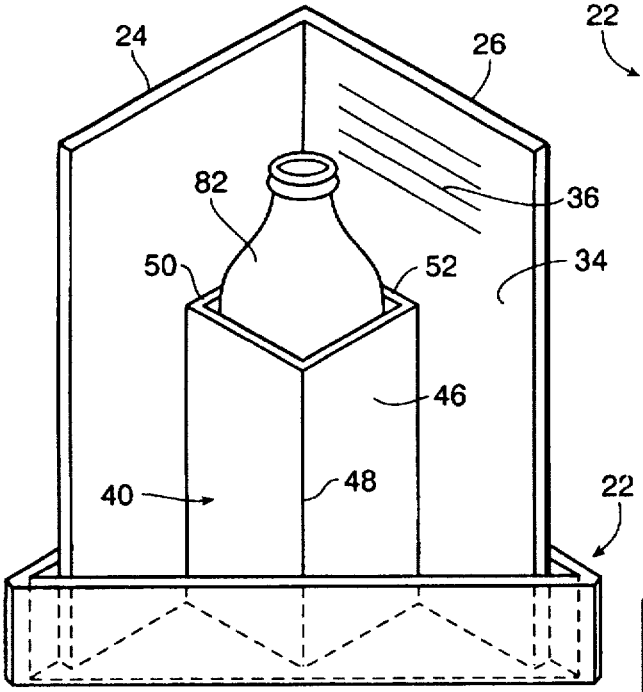
Figure 8:
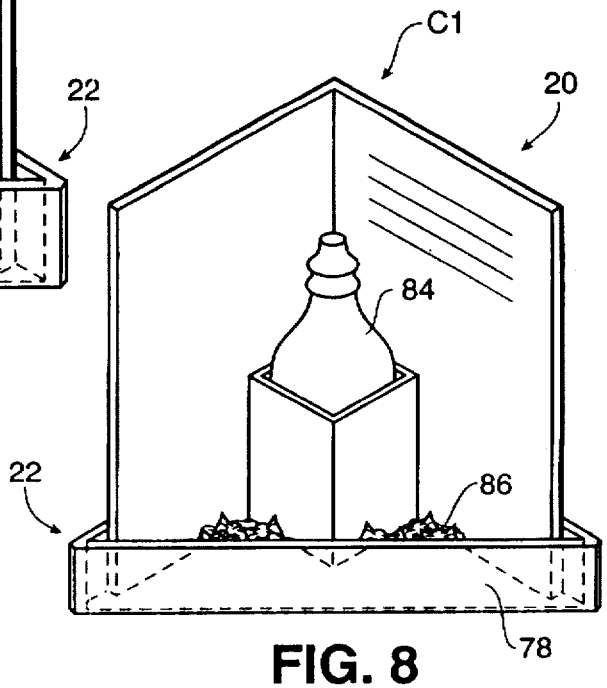
Figure 9:
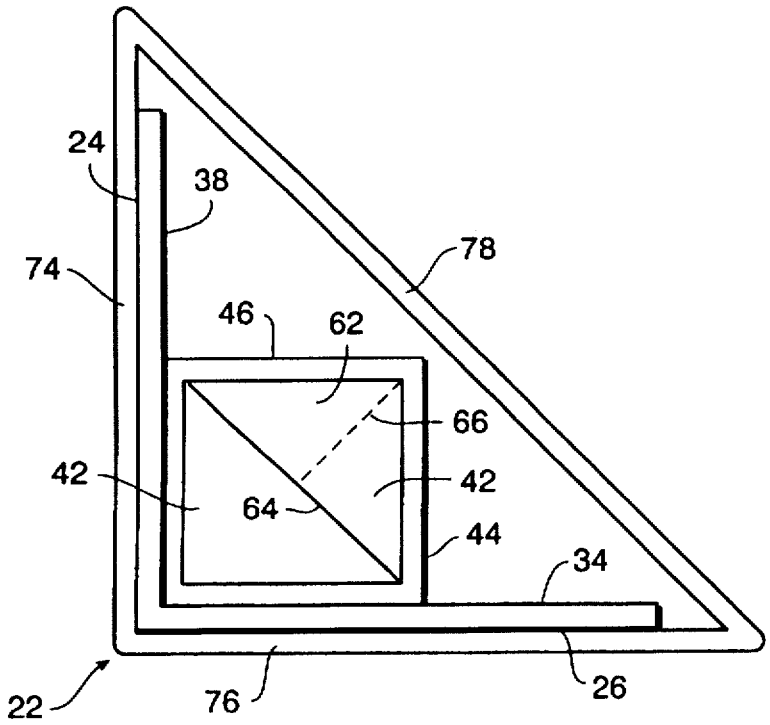

Having thus described the invention in general terms, reference will now be made to the accompanying drawings (four sheets) in which:

FIG. 1 an exterior perspective view of a novel greeting card device used in a greeting card assembly and which is constructed in accordance with and embodies the present invention;

FIG. 2 is an interior perspective view of a novel greeting card device used in a greeting card assembly and which is constructed in accordance with and embodying the present invention;

FIG. 3 is a vertical sectional view taken substantially along line 3—3 of FIG. 2;

FIG. 4 is a vertical sectional view, similar to FIG. 3, and showing a portion of the components forming part of the gift receiving pocket when the closure member thereof is in a partially folded up condition;

FIG. 5 is a perspective view of a tray forming part of the greeting card assembly of the present invention;

FIG. 6 is an exterior perspective view showing the novel greeting card device of FIG. 1 located within the tray of the invention;

FIG. 7 is an interior perspective view showing the novel greeting card device of FIG. 2, when in the opened position, located within the tray of the present invention;

FIG. 8 is an interior perspective view at a somewhat different angle showing the retention of a bottle, as a gift item, in the gift receiving pocket of the greeting card device and also showing a second gift item located within the tray of the assembly of the present invention; and FIG. 9 is a top plan view showing the completion of a bottom wall of a closure panel in the gift receiving pocket.

DETAILED DESCRIPTION OF PREFERRED EMBODIMENTS

Referring now in more detail and by reference characters to the drawings which illustrate a practical embodiment of the present invention, C designates a novel greeting card assembly comprised of a greeting card device 20 and a tray 22, as best illustrated in FIG. 6, 7 and 8 of the drawings. Although the greeting card device forming part of the assembly of the present invention is described in the aforesaid now issued U.S. Pat. No. 5,435,085, dated Jul. 25, 1995 and in the aforesaid co-pending U.S. patent application, the novel greeting card device will also be partially described herein to show its use in the assembly of the present invention.

The novel greeting card device 20 is comprised of a front panel 24 and a rear panel 26 connected along a suitable hinge line 28. In this case the hinge line 28 is essentially a fold line which allows the two panels 24 and 26 to be hingedly movable relative to one another.

Printed on a front face 30 of the panel 24 is a message or illustration 32. In like manner, printed on an interior face 34 of the rear panel 26 is a further message 36. The message 36 may form a part of or cooperate with the message 32. It should be understood that additional messages used and/or graphic illustrations could be incorporated on the interior face 34 of the panel 26 or the rear face of the rear panel 24.

Secured to an interior face 38 of the panel 24 and the interior face 34 of the panel 26 is a pocket-forming housing or receptacle 40 having an interior pocket 42 and which is comprised of a pair of receptacle-forming or so-called "pocket-forming" walls 44 and 46 connected at a receptacle hinge line 48. The housing or receptacle 40 also has another pair of receptacle forming walls 50 and 52 which are facewise disposed upon and respectively secured to the interior face 38 of the panel 24 and the interior face 34 of the rear panel 26, also as best shown in FIGS. 2–4 of the drawings.

In accordance with this construction, when the two panels 24 and 26 are open at approximately a 90° angle, as shown in FIG. 2, the walls 28 and 30 will also assume a perpendicular arrangement with respect to the panels 24 and 26, thereby forming the open upper ended interior chamber 42 in the receptacle 40. A gift item such as a bottle of perfume or a stem of a grown plant, etc. may then be disposed within the interior chamber 42.

The size of the chamber 42 which receives a gift item may be controlled by properly sizing the respective walls 50 and 52. By increasing the size of those walls 50 and 52 as well as the pocket-forming walls 44 and 46, it is impossible to increase the size of the chamber 42. Again, the chamber would be sized to receive a certain type of gift article. In the embodiment as shown, a flower is disposed within that pocket. However, as hereinafter described, a bottle can also be inserted in that pocket.

If desired, and for purposes of retaining a grown plant substance, a plastic liner 54 having an enclosed bottom wall 56 and an enclosing side wall 58, but which has an opened upper end 46, is disposed in the pocket. The upper edges of the side wall 60 may be adhesively secured to the interior surface of the receptacle forming walls 44 and 46, and possibly the walls 50 and 52, as best shown in FIG. 3. In this way, the liner 54 provides an interior pocket capable of holding water.

When it is desired to maintain the greeting card device in a closed position, it can be observed that the two receptacle forming walls 24 and 26 will also fold along the hinge line 38 so that they, in effect, become facewise disposed against the interior surfaces 38 and 34 of the panels 24 and 25. The interior faces of the receptacle forming walls 44 and 46 will also become disposed in flatwise engagement with one another when the greeting card panels 24 and 26 are shifted to the closed position. This will allow the greeting card to assume a fully closed position in the same manner as a conventional greeting card.

A pair of bottom wall sections 60 and 62 are also provided in the receptacle 26, as shown in FIGS. 3 and 4 of the drawings. These bottom wall sections 60 and 62 are effectively folded against the interior surfaces of the receptacle-forming walls 44 and 46 when the panels 24 and 26 are in the closed position. The bottom wall sections 60 and 62 are suitably connected along a fold line 64. However, when the panels 24 and 26 are moved to an opened position, the triangularly shaped bottom wall sections 60 and 62 will then begin to open to form a partial bottom wall, as shown in FIG. 4.

These sections 60 and 62 can be pushed to be flat so that the closure wall sections 60 and 62 are in a position where they will form a fully enclosing closure wall in a plane which is perpendicular to the plane of the receptacle-forming walls 44 and 46 and the receptacle-forming walls 50 and 52. This closure wall 54 is still rigid and supportive of a gift item. Moreover, the closure wall can be folded up such that the two bottom closure sections 60 and 62 are folded along the fold line 64 and again assume a facewise disposition against the interior surfaces of the receptacle-forming walls 44 and 46.

The aforesaid U.S. Pat. No. 5,435,085, dated Jul. 25, 1995, as well as the aforesaid co-pending patent application also identifies certain other modified forms of greeting card devices which can also be used in accordance with the present invention.

Referring now to FIGS. 5–9 of the drawings, the tray 22 also forms a part of the greeting card arrangement and is used to hold a greeting card in an upright position, as best shown in FIGS. 6–8 of the drawings. The tray 22 is more fully illustrated in FIG. 5 of the drawings and comprises a triangularly shaped bottom wall 70 along with a peripherally extending side wall 72 which is secured to and extends upwardly from the bottom wall 70. The side wall 72 includes a pair of shorter side wall sections 74 and 76, as well as a longer hypotenuse-forming side wall section 78. By reference to FIGS. 6, 7 and 8 of the drawings, it can be observed that the interior surfaces of the two shorter wall sections 74 and 76 engage the exterior faces of the panels 24 and 26, respectively. The outer edges of the two panels 24 and 26 will thereupon abut against the ends of the longer side wall section 78, as shown in FIGS. 7 and 8 of the drawings.

The tray 22, in accordance with this construction, forms an interior gift receiving area 80 in a manner as best illustrated in FIGS. 7–9 of the drawings. In the embodiment of the invention as illustrated in FIG. 7, a bottle of wine 82 may be disposed within the pocket 42. However, this is only one form of gift item which can be received within that pocket. FIG. 8 illustrates a perfume bottle 84 received within the pocket 42. In addition, the auxiliary gift receiving area 80 of the tray 22 may be provided with, for example, papier-mache holding additional gift items such as candies 86. Thus, it can be seen that gift items can be located in the gift receiving area 80 which are complimentary to that in the pocket 42.

The tray 22 is preferably formed of the same paper or paperboard material used in the formation of the greeting card. Moreover, it should have essentially the same surface finish and the like. It should also be understood that while the tray has been uniquely designed to hold the greeting card devices of the present invention, it is by no means so limited. Thus, for example, this tray can be used to hold a variety of other types of greeting cards.

It can be seen that the greeting card assembly of the present invention is highly effective in that it allows a sender of a greeting card to include a flower or like grown plant or other gift and potentially two or more gifts along with a greeting card itself. The greeting card assembly of the invention provides a suitable receptacle which is sized for holding the gift. Further, the tray has a space for retaining a gift along with the greeting card and more importantly, the greeting card itself will be retained by the recipient.

One of the unique aspects of the invention is that the greeting card itself literally will cause the formation of a gift receiving pocket when the greeting card is opened and rested in an upright position on the bottom edges of the two panels thereof within the tray when the panels are located at approximately a 90 degree angle relative to one another.

Thus there has been illustrated and described a unique and novel greeting card assembly which offers the availability of a greeting card and a tray for holding the greeting card. In this way, the greeting card assembly fulfills all of the objects and advantages which have been sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what I desire to claim and secure by letters patent is:

1. A combination of a greeting card device which presents a greeting message and provides for retention of a gift item in relationship to the greeting card device and a retaining tray for holding the greeting card device in an upright position, said combination comprising:

a) a greeting card device comprised of a pair of panels hingedly connected to one another and which are capable of having inner surfaces facewise disposed against one another and separated so that the panels are angularly located relative to one another;

b) a message on at least one of the panels for presenting a greeting message to the recipient of the greeting card device;

c) pocket forming means located between the two panels for opening to form a gift item receiving pocket with an open upper end upon placing the panels in an angular relationship relative to one another and which pocket is sized to receive a gift item and where the gift item can be inserted into said pocket through an open upper end;

d) a tray having a card receiving space for receiving a lower end of the card device to thereby hold the card device in an upright position when the panels are separated and angularly located relative to one another; and d) said tray generally snugly engaging the panels of the greeting card, said tray having a bottom wall and an enclosing side wall, said side wall being shaped and sized to hold the panels both in an upright position and in a generally open position when the panels are separated, so that the tray and greeting card device are effective in holding a gift item in said pocket in a generally upright position and thus allowing the greeting card and tray combination to be permanently retained and also retaining the gift item in an upright position.

2. The combination of claim 1 further characterized in that the means located between the two panels is a hinge means for hingedly connecting the panels.

3. The combination of claim 1 further characterized in that the hinge means is a fold line.

4. The combination of claim 1 further characterized in that the pair of panels are normally closed in a position where the interior faces of each of the panels are facewise disposed against one another and opened to a position where the two panels can be located at an 90 degree angle relative to one another, and that the means forming a pocket between the pair of panels is a pair of pocket-forming walls which are hingedly connected to the interior faces of the panels.

5. The combination of claim 1 further characterized in that the tray has a bottom wall and an upstanding tray side wall engages the panels of the card device when the panels are angularly located relative to one another.

6. The combination of claim 5 further characterized in that said tray is triangularly shaped.

7. The combination of claim 5 further characterized in that said tray is constructed of a paper material.

8. A greeting card assembly which presents a written or pre-printed greeting and also presents one or more gift items along therewith and in relationship to the printed greeting, said greeting card assembly comprising:

a) a first paper material panel;

b) a second paper material panel hingedly connected to said first paper material panel;

c) a first pocket-forming wall hingedly connected to an interior surface of said first panel;

d) a second pocket-forming wall hingedly connected to an interior surface of said second panel and which lie against one another when said first and second panels are facewise juxtaposed relative to one another and which open at an upper end to form a gift receiving pocket capable of holding a gift item when said panels are angularly located relative to one another to form a greeting card device and where the gift item can be inserted into said pocket through the open upper end;

e) a tray bottom wall engaging lower ends of each of said panels when each of the said panels are angularly located relative to one another;

f) a tray side wall having portions which engage said panels when the panels are angularly located relative to one another; and g) said tray side wall and tray bottom wall having both a size and shape to generally snugly engage the panels of the greeting card to hold the panels both in an upright position and in a generally open position when the panels are separated, such that the tray and greeting card device are effective in holding a gift item in said pocket in a generally upright position and thus allowing the greeting card device and tray combination to be permanently retained and also retaining the gift item in an upright position.

9. The greeting card assembly of claim 8 further characterized in that said pocket-forming walls each have first ends connected to the panels and are hingedly connected to one another at their opposite ends.

10. The greeting card assembly of claim 9 further characterized in that each of said pocket-forming walls are capable of lying in approximately perpendicular relationship to one another to form a rectangularly shaped pocket when the two panels are located in an angular position relative to one another.

11. The greeting card assembly of claim 8 further characterized in that said tray bottom wall and tray side wall are triangularly shaped, said tray side wall having three side wall sections and where two of said side wall sections fully engage lower portions of exterior faces of said panels when said panels are angularly located relative to one another.

12. The greeting card assembly of claim 11 further characterized in that said tray side wall and bottom wall are formed of a paper material.

13. The greeting card assembly of claim 8 further characterized in that a waterproof liner is secured to said pair of pocket-forming walls and is capable of retaining water therein when a grown plant stem is inserted into the gift receiving pocket.

14. The greeting card assembly of claim 11 further characterized in that each of the pair of pocket-forming walls are facewise disposed against an interior surface of each of the panels when the two panels are located in facewise juxtaposition with one another.

15. The greeting card assembly of claim 11 further characterized in that a bottom closure member is associated with at least one of the pocket-forming walls and is capable of being located in perpendicular relationship to each of the pocket-forming walls when the walls are opened relative to one another.

16. A tray for holding a multi-panel greeting card having a pair of panels hingedly connected to one another in an upright position and in an opened position so that said panels are retained in an angular relationship relative to one another, and where the pair of panels of said greeting card are capable of having inner surfaces facewise disposed against one another and separated so that the panels are angularly located relative to one another, and with said greeting card further comprising pocket forming means located between the two panels for opening to form a gift item receiving pocket upon placing the panels in an angular relationship relative to one another and which pocket is sized to receive a gift item said tray comprising:

a) a relatively flat triangularly shaped bottom wall capable of engaging lower ends of the panels of the greeting card; and b) a triangularly shaped upstanding side wall surrounding said bottom wall and adapted to engage portions of the panels of the greeting card when the greeting card is in an upright position and thereby hold the greeting card in an opened position.

17. The greeting card assembly of claim 16 further characterized in that said tray is formed of a paper material.

18. The greeting card assembly of claim 16 further characterized in that said greeting card is a two panel greeting card and said tray has three side wall sections and two of which fully engage exterior surfaces of the panels along lower portions thereof when the panels are opened relative to one another.

19. A combination of a greeting card device which presents a greeting message and provides for retention of a gift item in relationship to the greeting card device and a retaining tray for holding the greeting card device in an upright position, said combination comprising:

a) a greeting card device comprised of a pair of outer panels hingedly connected to one another and which are capable of having inner surfaces facewise disposed against one another and separated so that the panels are angularly located relative to one another;

b) said outer panels being in a normally closed position and having interior faces which are facewise disposed against one another when in the closed position and which can be opened to a position when the outer panels can be located at a 90 degree angle relative to one another;

c) a message on at least one of the panels for presenting a greeting message to the recipient of the greeting card device;

d) pocket forming means comprising a pair of pocket forming walls located between the two outer panels and being hingedly connected to the interior faces of said panels for opening to form a gift item receiving pocket upon placing the outer panels in an angular relationship relative to one another and which pocket is sized to receive a gift item; and e) a tray having a card receiving space for receiving a lower end of the card device to thereby hold the card device in an upright position when the panels are separated and angularly located relative to one another.

20. A combination of a greeting card device which presents a greeting message and provides for retention of a gift item in relationship to the greeting card device and a retaining tray for holding the greeting card device in an upright position, said combination comprising:

a) a greeting card device comprised of a pair of panels hingedly connected to one another and which are capable of having inner surfaces facewise disposed against one another and separated so that the panels are angularly located relative to one another;

b) a message on at least one of the panels for presenting a greeting message to the recipient of the greeting card device;

c) pocket forming means located between the two panels for opening to form a gift item receiving pocket upon placing the panels in an angular relationship relative to one another and which pocket is sized to receive a gift item; and d) a triangularly shaped tray having a bottom wall and a tray upstanding side wall which forms a card receiving space for receiving a lower end of the card device to thereby hold the card device in an upright position when the panels are separated and angularly located relative to one another, said tray side wall engaging the panels of the card device when the panels are angularly located relative to one another.

21. A greeting card assembly which presents a written or pre-printed greeting and also presents one or more gift items along therewith and in relationship to the printed greeting, said greeting card assembly comprising:

a) a first paper material panel;

b) a second paper material panel hingedly connected to said first paper material panel;

c) a first pocket-forming wall hingedly connected to an interior surface of said first panel;

d) a second pocket-forming wall hingedly connected to an interior surface of said second panel and which lie against one another when said first and second panels are facewise juxtaposed relative to one another and which open to form a gift receiving pocket capable of holding a gift item when said panels are angularly located relative to one another;

e) a tray comprising a bottom wall engaging lower ends of each of said panels when each of the said panels are angularly located relative to one another; and f) said tray also comprising a triangularly shaped tray side wall having three side wall sections, two of said side wall sections having portions which engage exterior faces of said panels when the panels are angularly located relative to one another.

22. The greeting card assembly of claim 21 further characterized in that said tray side wall and bottom wall are formed of a paper material.

23. The greeting card assembly of claim 21 further characterized in that each of the pair of pocket-forming walls are facewise disposed against an interior surface of each of the panels when the two panels are located in facewise juxtaposition with one another.

24. The greeting card assembly of claim 21 further characterized in that a bottom closure member is associated with at least one of the pocket-forming walls and is capable of being located in perpendicular relationship to each of the pocket-forming walls when the walls are opened relative to one another.

25. A greeting card assembly which presents a written or pre-printed greeting and also presents one or more gift items along therewith and in relationship to the printed greeting, said greeting card assembly comprising:

a) a first paper material panel;

b) a second paper material panel hingedly connected to said first paper material panel;

c) a first pocket-forming wall hingedly connected to an interior surface of said first panel;

d) a second pocket-forming wall hingedly connected to an interior surface of said second panel and which lie against one another when said first and second panels are facewise juxtaposed relative to one another and which open to form a gift receiving pocket capable of holding a gift item when said panels are angularly located relative to one another;

e) a waterproof liner secured to said pocket forming walls and capable of retaining water therein when a grown plant stem is inserted into the gift receiving pocket;

f) a tray bottom wall engaging lower ends of each of said panels when each of the said panels are angularly located relative to one another; and g) a tray side wall having portions which engage said panels when the panels are angularly located relative to one another.

26. A combination of a greeting card device which presents a greeting message and provides for retention of a gift item in relationship to the greeting card device and a retaining tray for holding the greeting card device in an upright position, said combination comprising:

a) a greeting card device comprised of a pair of panels hingedly connected to one another and which are capable of having inner surfaces facewise disposed against one another and separated so that the panels are angularly located relative to one another;

b) a message on at least one of the panels for presenting a greeting message to the recipient of the greeting card device;

c) pocket forming means located between the two panels for opening to form a gift item receiving pocket upon placing the panels in an angular relationship relative to one another and which pocket is sized to receive a gift item;

d) a tray having a bottom wall and a tray upstanding side wall which forms a card receiving space for receiving a lower end of the card device to thereby hold the card device in an upright position when the panels are separated and angularly located relative to one another, said tray side wall having a pair of side wall sections which snugly engage lower ends of the panels of the card device when the panels are angularly located relative to one another.

27. The combination of claim 26 further characterized in that the means located between the two panels is a hinge means for hingedly connecting the panels.

28. The combination of claim 26 further characterized in that the hinge means is a fold line.

29. The combination of claim 1 further characterized in that the pair of panels are normally closed in a position where the interior faces of each of the panels are facewise disposed against one another and opened to a position where the two panels can be located at an 90 degree angle relative to one another, and that the means forming a pocket between the pair of panels is a pair of pocket-forming walls which are hingedly connected to the interior faces of the panels.

* * * * *